US006216276B1

(12) United States Patent
Eibert

(10) Patent No.: US 6,216,276 B1
(45) **Date of Patent: *Apr. 17, 2001**

(54) PADDED ATHLETIC GLOVES

(76) Inventor: Bruce A. Eibert, 1476 Semi Dr., Reno, NV (US) 89512

( * ) Notice: Subject to any disclaimer, the term of this patent is extended or adjusted under 35 U.S.C. 154(b) by 0 days.

This patent is subject to a terminal disclaimer.

(21) Appl. No.: 09/346,224

(22) Filed: Jul. 1, 1999

Related U.S. Application Data

(63) Continuation-in-part of application No. 08/886,631, filed on Jul. 1, 1997, now Pat. No. 5,926,847.

(51) Int. Cl.[7] ..... A41D 19/00
(52) U.S. Cl. ..... 2/161.2
(58) Field of Search ..... 2/16, 21, 159, 2/161.1, 161.2, 161.3, 161.4, 161.5, 161.6, 163, 167, 917; 473/59, 458

(56) References Cited

U.S. PATENT DOCUMENTS 4,748,690 * 6/1988 Webster ..... 2/19
4,843,651 * 7/1989 Gramza et al. ..... 2/161
4,881,276 * 11/1989 Swan ..... 2/161
5,079,776 * 1/1992 Crawford ..... 2/20
5,330,391 * 7/1994 Mitchell ..... 473/59
5,632,045 * 5/1997 Chase et al. ..... 2/161.6
5,675,839 * 10/1997 Gordon et al. ..... 2/159
5,692,242 * 12/1997 Tekerman et al. ..... 2/161.1
5,697,104 * 12/1997 Welton ..... 2/159
5,752,279 * 5/1998 Hochmuth ..... 2/161.1
5,787,506 * 8/1998 Wilder et al. ..... 2/161.1
5,926,847 * 7/1999 Eibert ..... 2/161.2
5,987,646 * 11/1999 Bolmer ..... 2/161.1
5,991,926 * 11/1999 Lakisiewicz ..... 2/168

* cited by examiner

*Primary Examiner*—John J. Calvert
*Assistant Examiner*—Katherine Moran
(74) *Attorney, Agent, or Firm*—Townsend and Townsend and Crew, LLP

(57) ABSTRACT

The invention provides exemplary athletic, driving and work gloves and methods for their use. In an exemplary embodiment, a flexible athletic glove is provided having a glove body having a palmar side and a dorsal side. A plurality of finger portions and a thumb portion each having a palmar side and a dorsal side are operably attached to said glove body. The glove further comprises at least one resilient pad comprising silicon foam operably attached to the palmar side of said glove body.

18 Claims, 7 Drawing Sheets

PADDED ATHLETIC GLOVES

CROSS-REFERENCES TO RELATED APPLICATIONS

This application is a continuation-in-part of and claims the benefit of U.S. Application No. 08/886,631, now U.S. Pat. No. 5,926,847 filed Jul. 1, 1997, the complete disclosure of which is incorporated herein by reference.

BACKGROUND OF THE INVENTION

The present invention relates generally to the field of gloves for use in sports, and in particular, to padded athletic, work and driving gloves.

A large number of sports participants use sports gloves or other protective hand covering. Some participants use gloves to attempt to enhance their performance in their chosen sport. Others chose to wear gloves as a protective measure for their hands and/or wrists. As a result, a large number of gloves have been designed, manufactured and sold to sports participants, some of which claim to address one or more of the needs of the sports participant. In general, these gloves may be placed into one or more of three different categories.

The first such category includes gloves designed to provide protective padding to the palm and/or fingers of the sports participant. For example, individuals participating in weight lifting for either sport or exercise often wear padded, fingerless gloves to provide protection to the palms of the hands. Individuals who ride bicycles for sport or exercise also commonly use such padded gloves. In addition, several gloves have been designed which include padding in the palm and/or the fingers for use with baseball or softball mitts. In this situation, wearers of the padded glove would first put on the glove and then insert their hand into the baseball or softball mitt, thereby providing extra padding for use while playing in the field.

The second general category of sports gloves is comprised of gloves designed to assist the wearer in catching a ball or other object. For example, wide receivers in football and soccer goalies often wear gloves designed to increase the likelihood that a thrown or kicked ball will be caught by the wearer of the glove. In general, these gloves are fairly tight fitting and include a rougher palm and/or finger surface to increase the wearer's grip.

The third category of athletic gloves includes gloves designed to enhance the grip of the wearer on an object already held within the user's hands. For example, baseball players typically wear batting gloves during both practice and games while facing live pitching. Similar types of gloves also are used by racquetball players. Gloves in this category are designed to be fairly tight fitting and very flexible with hand movements in order to enhance the wearer's grip on the racquet, bat or club, despite the presence of perspiration or moisture on the wearer's hands. While containing gripenhancing qualities, these gloves typically provide little, if any, protective padding to the hands and fingers.

Golf gloves fall within this third category of grip enhancing gloves. The game of golf, however, presents unique problems when designing a glove for use with that sport. Golf gloves are typically made to be rather tight fitting on the user's hand and also extremely flexible to allow a full range of hand motion. As a result, golf gloves are typically made of very thin, supple leather designed to allow a user to have an increased grip on the golf club, without sacrificing the "feel" a golfer has for the club. Unlike baseball, in which the typical batter does not interlock the hand or fingers on the handle of the bat, the golfer, depending on the grip used, typically interlocks or overlaps the two hands on the golf club handle. Such a grip further enhances the need that the golf glove be tight fitting, thin, and supple to allow this interlocking grip while still permitting the user to feel the golf club during play. The situation is further exacerbated by the fact that the golf club handle is much smaller in diameter than a typical baseball bat or racquetball racquet handle, resulting in the need for a glove that will not allow the club to rotate in the golfer's hands when striking the golf ball or ground.

As a result of the above unique requirements, golf gloves have typically comprised thin, tight fitting gloves made of supple leather. Such gloves have been fairly successful in providing wearers with grip enhancing qualities and, to some extent, protection from blisters or other abrasions to the surface of the hand and fingers. While beneficial to the typical once a week or once a summer golfer, such gloves provide minimal, if any, protection to the wearer from vibrations or shocks caused by the club head striking the ball or ground.

Golfing enthusiasts may find themselves on the golf course or at a driving range several times in a given week. Particularly for those golfers who tend to hit a large number of balls at the driving range, the successive and repeated nature of the shock transmitted into the hands, wrists and arms of the golfer may result in cumulative trauma disorders to the hands, wrists, and arms. The golfer who hits literally hundreds to thousands of golf balls per day or per week may develop physical problems from the vibrations generated when the club head strikes the ball or ground. Such contact by the club head results in a low frequency vibration being transferred up a golf club's shaft into the user's hands, wrists and arms.

As a result, it would be desirable to have a golf glove which could be used to dampen the vibrations caused by the golf club thereby protecting, to at least some extent, the hands, wrists and arms of the golfer. It would be further desirable if such a golf glove were padded in a manner that allowed the golf glove to remain tight fitting on the wearer's hands without providing a thick, cumbersome padding between the golfer's hands and the club. In one instance, it would be desirable to provide a golf glove which provides grip enhancing characteristics of an ordinary golf glove and yet provides some protection to the wearer from the vibrating golf club.

SUMMARY OF THE INVENTION

In one exemplary embodiment, a flexible athletic glove is provided having a palmar side and a dorsal side. A plurality of finger portions and a thumb portion, each having a palmar side and a dorsal side, are operably attached to the glove body. A first resilient pad comprising silicon (or silicone) foam is operably attached to the palmar side of the glove body. In one aspect, a second resilient pad is operably attached to the palmar side of the thumb portion, and a third resilient pad is operably attached to the palmar side of one of the finger portions, with both the second and third resilient pads also comprising silicon foam.

In one aspect of the invention, the third resilient pad is operably attached to the palmar side of a first finger portion which is adapted to receive the index finger. In another aspect, resilient pads comprising silicon foam also are operably attached to the remaining finger portions. In this manner, a fourth resilient pad is operably attached to the palmar side of a second finger portion which is adapted to receive the middle finger, a fifth resilient pad is operably attached to the palmar side of a third finger portion which is adapted to receive the ring finger, and a sixth resilient pad is operably attached to the palmar side of a fourth finger portion which is adapted to receive the little finger.

In one aspect, the resilient pads have a thickness between about 0.010 inches and about 0.10 inches, and, in another aspect, between about 0.012 inches and about 0.014 inches. In still another aspect, first resilient pad has a thickness between about 0.050 inches and about 0.060 inches. The silicon foam preferably has a durometer in the range of about 45 Shore A to about 55 Shore A and a specific gravity in the range of about 1.13 to about 1.16. The compression deflection of the silicon foam resilient pads varies depending upon the thickness of the resilient pad.

In another aspect of the invention, the first resilient pad covers between about 30 percent and about 80 percent of the palmar side of the glove body. In this manner, the pad is of sufficient size to wrap at least part way around, for example, the golf glove handle or "grip" when the wearer of the glove holds a golf club. In a further aspect of the invention, the second and third resilient pads cover between about 70 percent and about 100 percent of the palmar side of the thumb and first finger portions. In this manner, the second and third resilient pads also contact the golf club grip when the wearer holds the golf club. In a still further aspect, the second through sixth resilient pads each cover between about 30 percent and about 70 percent of the palmar side of the corresponding thumb and finger portions.

In one aspect of the invention, the golf glove further comprises a band of shirred elastic that is operably attached to the glove body and extends at least part way around the glove body. In this manner, the band of shirred elastic constricts the glove body material near the wearer's wrist, thereby providing a snug and comfortable fit around the wrist. In one aspect, the flexible golf glove further comprises a glove closure mechanism. Glove closure mechanisms include a hook and loop fastener material, such as that sold under the trade name VELCRO, straps, snaps and the like, or a combination thereof.

In a further aspect of the invention, the glove body, the finger portions and the thumb portion comprise cabretta leather. In this manner, the glove remains supple, thereby allowing the wearer to use a tight fitting glove that allows ample freedom of movement of the wearer's hand. A glove comprised primarily of cabretta leather also allows the wearer to maintain the feel of the golf club or other item in the wearer's hands. In a further aspect, at least a part of the dorsal portion of the glove body comprises a nylon mesh. In this way, the nylon mesh provides ventilation to the back of the user's hand to facilitate the evaporation of perspiration or other moisture from the wearer's gloved hand.

In an alternative embodiment, a flexible athletic or driving glove is provided comprising a glove body, a plurality of partial finger portions and a partial thumb portion, wherein the glove body, partial finger portions and partial thumb portion each have a palmar side and a dorsal side. The partial finger portions and partial thumb portion are operably attached to the glove body and are adapted to cover only a portion of a glove wearer's thumb and fingers. At least one resilient pad comprising silicon foam is operably attached to the palmar side of the glove body. In this manner, the resilient pad comes into contact with an item, such as a golf club grip, being held by the glove wearer.

In another aspect, the embodiment further includes a plurality of resilient pads comprising silicon foam operably attached to the palmar side of the thumb portion and finger portions. In one aspect, the first finger portion is adapted to receive the index finger. In this manner, the resilient pads come into contact with an item, such as a golf club grip, held by the glove wearer.

In a further aspect, the athletic or driving glove includes resilient pads operably attached to the palmar side of each finger portion. In this manner, the glove comprises at least six resilient pads——a pad attached to the thumb portion, one pad attached to each of the four finger portions, and at least one pad attached to the glove body.

In one aspect, the resilient pads have a thickness between about 0.010 inches and about 0.10 inches and, in another aspect, between about 0.012 inches and about 0.014 inches. In one aspect, the resilient pads comprise pre-formed, air-blown silicon foam pads. In another aspect, the at least one resilient pad is operably attached to the glove body with a plurality of stitches, and alternatively, with an adhesive.

In another embodiment of the present invention, a flexible glove comprises a glove body, and a thumb portion and finger portions operably attached to the glove body. A plurality of resilient pads comprising air-blown silicon foam are operably attached to the palmar sides of the glove body, thumb portion and at least one finger portion. In one aspect, the resilient pads are between about 0.010–0.10 inches thick.

The invention further provides an exemplary method for using a flexible athletic glove. First, a flexible athletic glove is provided as previously described and put on a hand. The athletic glove includes a glove body having a palmar side and a dorsal side, a first resilient pad operably attached to the palmar side of the glove body, and a plurality of finger portions and a thumb portion operably attached to the glove body. The athletic glove also has a second and a third resilient pad operably attached to a palmar side of the thumb portion and a palmar side of one of the finger portions, respectively. The method then involves the step of gripping an item, such as a golf club, in a manner which brings the first, second and third resilient pads in contact with the item, such as with the golf club grip. The method includes swinging the item, such as the golf club. Preferably, first through third resilient pads comprise silicon foam.

Other features and advantages of the invention will appear from the following description in which the preferred embodiment has been set forth in detail in conjunction with the accompanying drawings.

DESCRIPTION OF THE SPECIFIC EMBODIMENTS

Figure 1A:
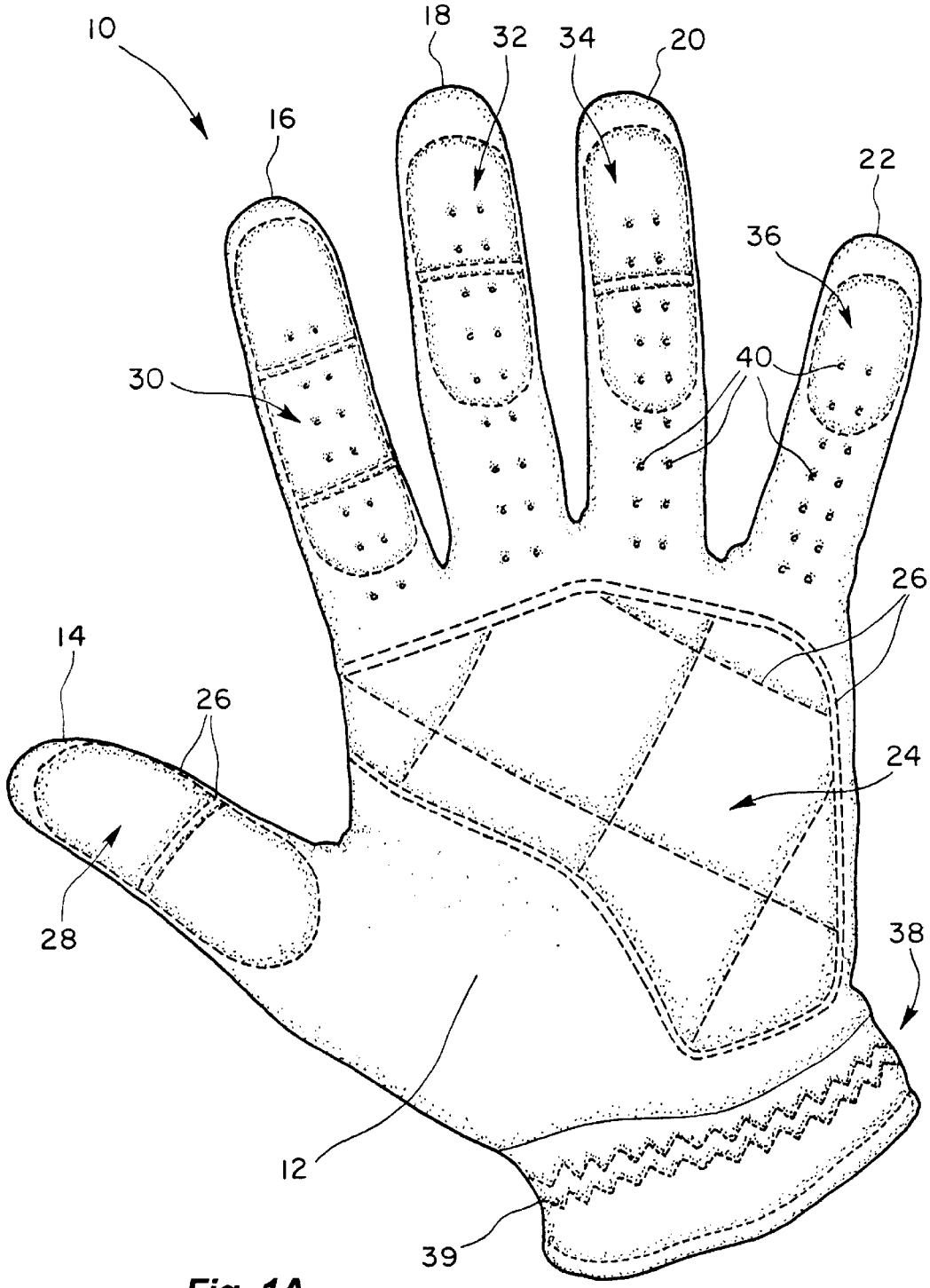
FIGS. 1A and 1B are perspective views of athletic gloves according to the present invention.

The invention provides exemplary padded athletic, driving and work gloves, and methods for their use. In one embodiment, the present invention provides an exemplary golf glove that will be particularly useful to a golfer who hits dozens of golf balls over a short period of time while on a driving range, a practice range and the like.

When a golfer strikes a golf ball, or the ground, low frequency vibrations occur in the golf club. Such vibrations travel up a golf club shaft and into the golfer's hands, wrists and arms. A golfer at a driving range typically stays in one location and hits a number of golf balls in a relatively short period of time. As a result, a large number of low frequency vibrations travel up the shaft and into the golfer's hands, wrists and arms in a short period of time. A golfer at a driving or practice range also may be required to hit golf balls off of a hard plastic and/or rubber mat that sits on a concrete pad. Such a hard surface further increases the shock a golfer feels when hitting the golf ball.

The cumulative effect of the vibrations can result in the golfer suffering from cumulative trauma disorders to the hands, wrists and arms. Information relating to cumulative trauma disorders (or CTDs) has been available to the safety industry for many years. CTDs, an example of which is carpal tunnel syndrome, arise when an individual performs the same function time and time again. While often associated with workplace injuries resulting from jackhammers, factory production line equipment, typing and the like, CTDs may also arise in a person who plays and practices golf or other sports requiring repetitive movements, contacts or trauma.

By wearing a golf glove according to the present invention, the golfer will be able to dampen the low frequency vibrations which occur in the golf club when the club strikes a ball or the ground. The resilient pads located on the palmar sides of the glove body, thumb portion and/or finger portions dampen the vibrations to provide some degree of protection to the golfer's hands, wrists and arms.

The resilient pads of the present invention are preferably constructed of silicon foam. Silicon foams pad of the present invention are air-blown silicon foam, formed in sheets or layers of a desired thickness. The sheets of silicon foam then are cut, or otherwise manipulated to produce pads having a desired shape and thickness. Resilient pads of the present invention do not comprise the gelatin-type material once used for breast implants and other applications. Such devices typically used a pocket or other structure to define the outer boundary of the silicon gel-containing device. In contrast, resilient pads of the present invention comprise silicon foam which hold the desired shape without the need for pockets and the like, although use of a pocket is not precluded by the present invention.

Pads made from other materials, such as neoprene, rubber, and other elastomers used in some sport gloves, typically cannot be made thin enough to sufficiently dampen the golf club vibrations felt in the user's hands, wrists and arms, while still allowing sufficient flexibility and feel in the golf glove. In contrast, silicon foam, because of its unique vibration damping characteristics, can be manufactured in a pad thin enough to allow the user to have a normal grip on the golf club while still providing ample vibration damping. Silicon foam suitable for use in resilient pads of the present invention is commercially available from Specialty Silicone Fabricators, Inc., of Paso Robles, Calif.

Unique characteristics of the silicon foam allows a relatively thin layer of material to reduce a large percent of the vibrations. The silicon foam translates the vibrations traveling axially up the golf club shaft into a lateral direction. Vibrations that would typically travel axially up the golf club shaft, through a golf glove, and into a golfer's hands, wrists and arms are now translated into a lateral direction by the silicon foam pads. This characteristic of the silicon foam results in a substantial decrease in the amount of vibrational energy that reaches the golfer's hands, wrists and arms. Part of the present invention is the recognition that using pads made from silicon foam, in certain locations on the golf glove, will result in a substantial decrease in vibrational energy that reaches the golfer's hands, wrists and arms. Further, the use of silicon foam pads on other athletic gloves, driving gloves and work gloves provides similar advantages without the need for thick, bulky pads of other materials.

Since silicon foam reduces the vibrations so effectively, resilient pads made from silicon foam can sufficiently dampen the vibrations and yet be made quite thin. In one embodiment, resilient pads made from silicon foam according to the present invention have a thickness between about 0.010 inches and about 0.10 inches, depending in part upon the application or type of glove in which the pads arc used. In one particular embodiment, resilient pads made from silicon foam have a thickness between about 0.010 inches and about 0.016 inches, and more preferably between about 0.012 inches and about 0.014 inches.

Resilient pads made from silicon foam have a durometer in the range of about 45 Shore A to about 55 Shore A and a specific gravity in the range of about 1.13 to about 1.16. The compression deflection will vary depending upon the thickness of the silicon foam resilient pad.

Furthermore, silicon foam's dynamic absorption characteristics show very little change with aging, and silicon foam shows very little change in transmissibility or resonant frequency over a large temperature range, from about −65 degrees Fahrenheit to about 300 degrees Fahrenheit. As a result, resilient pads made from silicon foam maintain their vibration damping characteristics over a temperature range experienced by even the most die hard golfer or sports enthusiast.

While golfers who are on a practice or driving range will likely see the most benefit of the present invention, golfers playing a round of golf would also benefit from such a golf glove. Golfers who are playing a round of golf typically, and hopefully, have much longer periods of time between swings of the club that strike a golf ball. However, the vibration damping effects of the present invention would benefit those golfers as well.

Referring now to FIGS. 1A, 1B, 2 and 3, athletic, work or driving glove embodiments of the present invention will be described in detail. While the embodiment described is intended as an exemplary golf glove, it will be appreciated by those skilled in the art that the present invention is not limited to golf gloves, and may include batting gloves, driving gloves, work gloves, gloves used for racquetball or biking, and a wide variety of gloves which benefit from vibration dampening pads therein.

One embodiment involves a flexible golf glove 10 which comprises a glove body 12 and a thumb portion 14 operably attached to the glove body 12. The thumb portion 14 preferably comprises a "keystone" thumb design. Such a design produces a thumb portion 14 having a single seam, as opposed to two seams.

Figure 2:
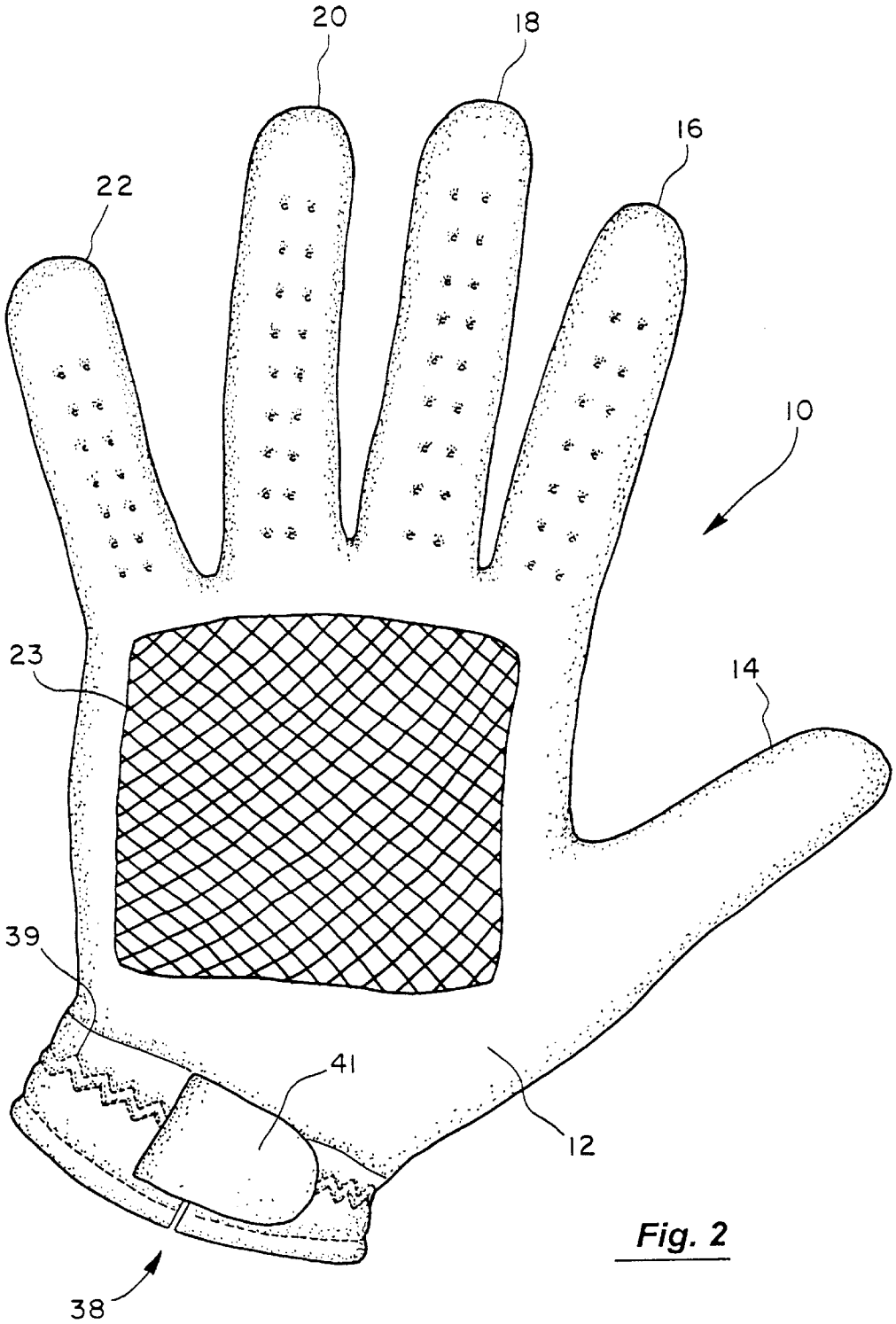
FIG. 2 is a perspective view of the dorsal side of the athletic glove of FIGS. 1A and 1B.
Figure 3:
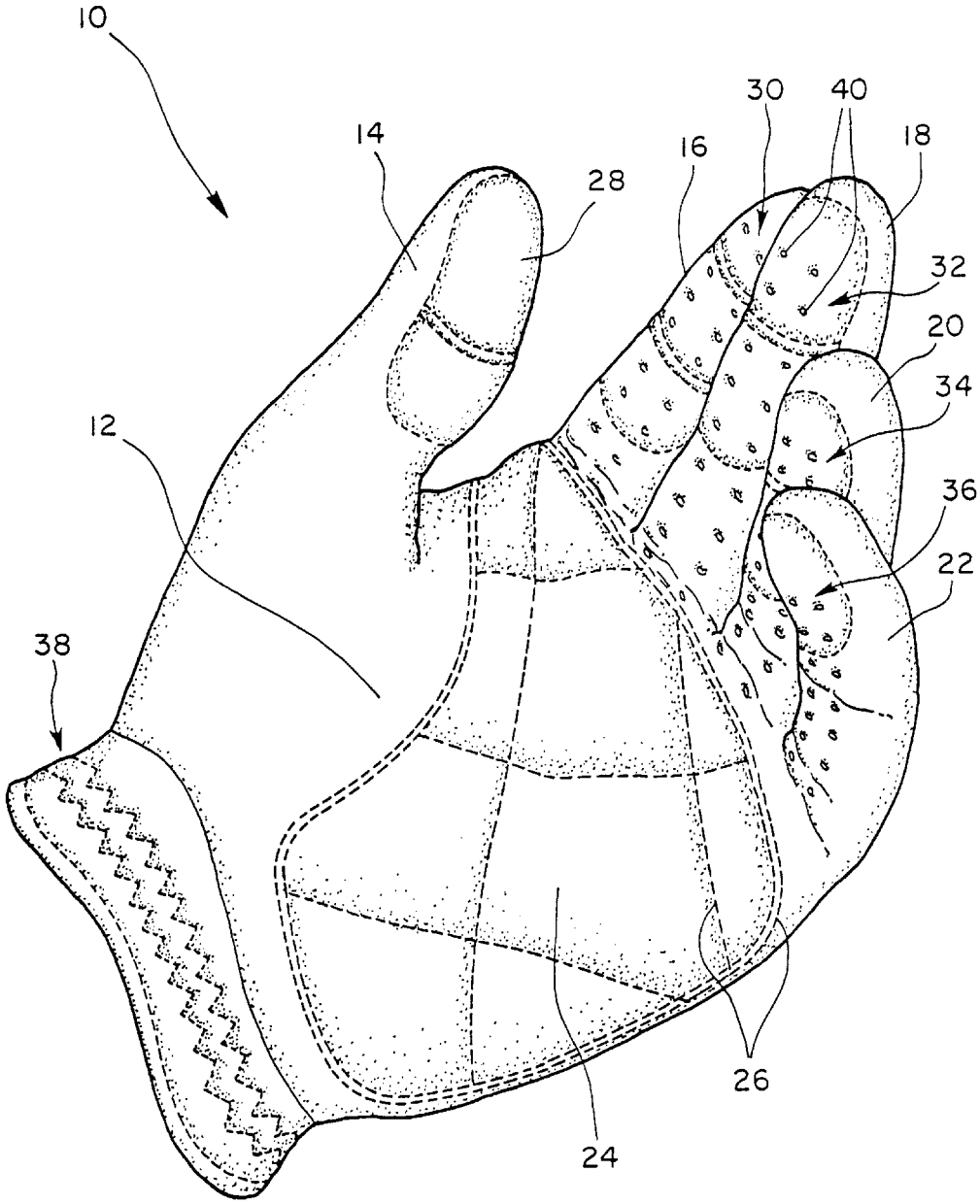
FIG. 3 illustrates the padded athletic glove of FIG. 1A with the fingers curled inward.

The flexible golf glove 10 further includes four finger portions operably attached to glove body 12. As depicted in FIGS. 1–3, a first finger portion 16 is adapted to receive the index finger, a second finger portion 18 is adapted to receive the middle finger, a third finger portion 20 is adapted to receive a ring finger, and fourth finger portion 22 is adapted to receive the little finger. In one embodiment, the glove body, thumb and finger portions are made of thin supple leather, such as that made from goat skin (commonly referred to as cabretta leather). Alternatively, the glove body 12, thumb portion 14 and/or finger portions 16, 18, 20, and 22 are made from synthetic leather or other synthetic material. In one embodiment, work gloves of the present invention have a glove body made from rawhide.

In one embodiment, the leather used to construct the golf glove 10 has a thickness that is between about 0.003 inches and about 0.007 inches, although other thicknesses may be used within the scope of the present invention. In one embodiment, the glove body 12, including the dorsal portion, is made from thin supple leather. Alternatively, at least a part of the dorsal portion of the glove body 12 comprises nylon mesh 23, as depicted in FIG. 2. Such nylon mesh 23 helps facilitate airflow to the back of the wearer's hand, thereby assisting in evaporation of perspiration. Other materials, such as cotton, other polyesters and the like may be used in lieu of nylon mesh 23, and are anticipated by the present invention.

Golf glove 10 further includes a first resilient pad 24 which is attached to the palmar side of glove body 12. First resilient pad 24 is preferably sewn into the interior of said glove body 10 using stitches 26. In this way, resilient pad 24 will be close to the wearer's skin on the inside of glove body 12. Preferably, first resilient pad 24 is sewn directly to the leather glove body 12 with no additional material covering the first resilient pad 24 on the inside of glove body 12. Alternatively, the first resilient pad 24 can be sewn to the inside of glove body 12 and then covered with a thin layer of fabric, comprising cotton or the like, to cover the first resilient pad 24. In addition to sewing the first resilient pad 24 to the inside of glove body 12, the pad can be attached by adhesive, such as epoxy, or the like.

The flexible golf glove 10 further includes resilient pads on the thumb portion and each of the four finger portions. As depicted in FIGS. 1A and 3, a second resilient pad 28 is operably attached to the palmar side of thumb portion 14. Likewise, a third resilient pad 30, a fourth resilient pad 32, a fifth resilient pad 34, and a sixth resilient pad 36, are operably attached to the palmar side of finger portions 16, 18, 20, 22, respectively. As with first resilient pad 24, each of the thumb and finger portion pads 28, 30, 32, 34, 36 preferably are attached to the inside of the glove thumb portions and finger portions. Stitches 26 hold the resilient pads 28, 30, 32, 34, 36 in place with respect to the thumb portion 14 and finger portions 16, 18, 20, 22.

As with the first resilient pad 24 on the glove body 12, the second through sixth resilient pads can also be attached to the thumb and finger portions by adhesive and the like. The second through sixth resilient pads may also be covered on the side closest to the wearer's hand by a thin layer of fabric, such as cotton and the like, to provide additional comfort to the wearer.

As shown, the first resilient pad 24 preferably covers between about 30 percent and about 80 percent of the palmar portion of golf body 12, and more preferably between about 30 percent and about 70 percent of the palmar portion of glove body 12. The first resilient pad 24 preferably begins from about ¼ inch to about ⅜ inch below where the finger portions operably attach to the glove body 12. The physical dimensions of the first resilient pad will correspond to the golf glove size (i.e., small, medium, large, extra-large). Such a pad size helps insure that a golf club held by the wearer of the golf glove 10 comes into contact with resilient pad 24.

Figure 1B:
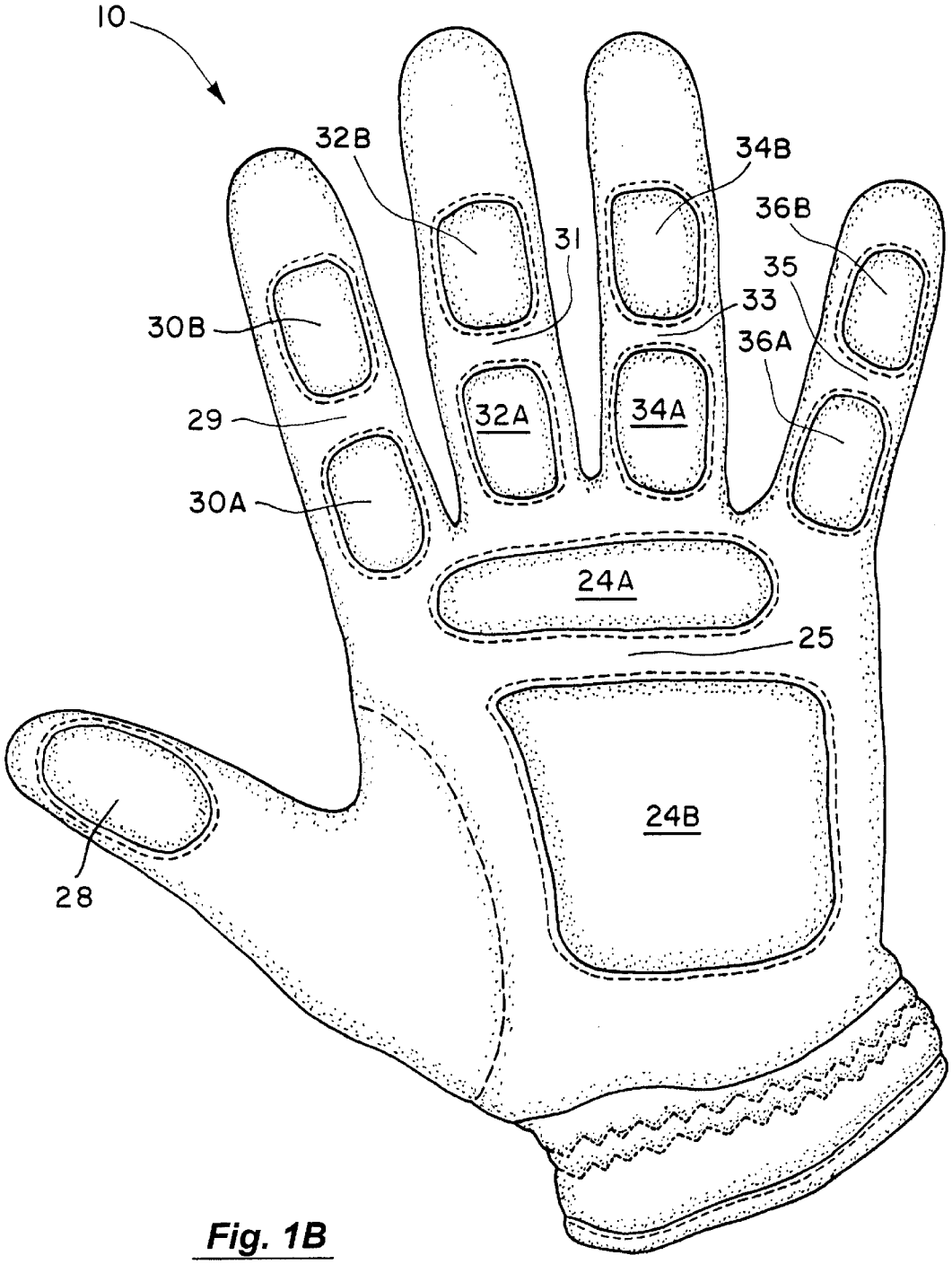

As depicted in FIGS. 1A and 1B, the second resilient pad 28 and the third resilient pad 30 each cover part of the palmar side of thumb portion 14 and first finger portion 16, respectively. Such second and third resilient pads 28, 30 preferably cover between about 30 percent and about 100 percent of the palmar side of said thumb and first finger portions 14, 16, and more preferably cover between about 30 percent and about 70 percent of the palmar side of said thumb and first finger portions 14, 16. Because a conventional golf grip relies extensively on the thumb and index finger, the resilient pads 28, 30 covering these finger and thumb portions are especially important.

The fourth, fifth and sixth resilient pads 32, 34, 36, preferably cover between about 30% and about 70% of the palmar side of the second, third and fourth finger portions 18, 20, 22, respectively. The fourth, fifth and sixth resilient pads 32, 34, 36 begin approximately ¼ inch from the tip of their respective finger portions in one embodiment. Such sizes of fourth, fifth and sixth resilient pads 32, 34, 36 provide sufficient padding to help dampen vibrational forces and yet are still intended to allow a wearer of golf glove 10 to feel the golf glove in the wearer's hand. In one particular embodiment, first through sixth pads have a thickness that is between about 0.050 inches and about 0.060 inches.

As a result, the first through sixth resilient pads are of sufficient size to provide vibration damping while allowing a wearer of the glove to have sufficient "feel" in the glove as it wraps around a golf club grip. Since, in the embodiment depicted in FIG. 1A, the second, third, fourth and fifth resilient pads 28, 30, 32, 34 extend over at least one finger or thumb joint, additional stitches 26 are used near the finger or thumb joints to help insure these resilient pads 28, 30, 32, 34 remain in place when the fingers are bent or extended. Such additional stitching helps to avoid bunching of the resilient pads at the finger and thumb joints. Alternatively, resilient pads of the present invention may be operably attached to the palmar side of glove body 12, thumb portion 14 and finger portions 16, 18, 20 and 22 using an adhesive, such as an epoxy, or the like. Such an arrangement is depicted in FIG. 1B.

First resilient pad 24 also may comprise two or more pad portions 24A and 24B separated by a small gap 25 as shown in FIG. 1B. Similarly, third resilient pad 30 may comprise two portions 30A and 30B separated by a gap 29, fourth resilient pad 32 may comprise two portions 32A and 32B separated by a gap 31, fifth resilient pad 34 may comprise two portions 34A and 34B separated by a gap 33, and sixth resilient pad 36 may comprise two portions 36A and 36B separated by a gap 35. Gaps 25, 29, 31, 33 and 35 are positioned to facilitate hand movements without bunching of the corresponding resilient pads. It will be appreciate hand move me in the art that pads 24, 30, 32, 34 and 36 each may comprise more than two portions within the scope of the present invention. For example, each finger portion may have three pad portions separated by two gaps, with the gaps generally aligned with two finger joints. Further, for example, second resilient pad 28 also may comprise two pads separated by a small gap positioned to be generally above the joint contained in the middle of the thumb.

One embodiment includes a band of shirred elastic 39 operably attached to glove body 12. Located near the wrist-most portion of the golf glove body 12, the shirred elastic 39 operates to constrict the glove body material to facilitate a snug and comfortable fit near the wrist. The shirred elastic 29 is operably attached to the glove body 12 by stitching, adhesive, or the like.

One preferred embodiment further includes a glove closure mechanism 38. Such a closure mechanism 38, in conjunction with the shirred elastic 39, helps insure that the golf glove 10 remains firmly on the wearer's hand by constricting the golf glove body 12 near the wearer's wrist. The golf glove closure mechanism 38 depicted in FIG. 2 comprises a hook and loop fastener material 41, similar to that marketed under the brand name Velcro, operably attached to the dorsal side of the golf glove body 12. In addition to a hook and loop fastener 41, the golf glove closure mechanism 38 may alternatively comprise straps, snaps, and the like, or some combination of hook and loop fastener material, straps, snaps and the like.

As further depicted in FIGS. 1 and 3, flexible golf glove 10 includes small holes 40 in the palmar and dorsal sides of finger portions 16, 18, 20, 22. As with holes in conventional golf gloves, these holes 40 are intended to permit air to reach a wearer's skin, thereby facilitating the evaporation of perspiration or other moisture.

Figure 4:
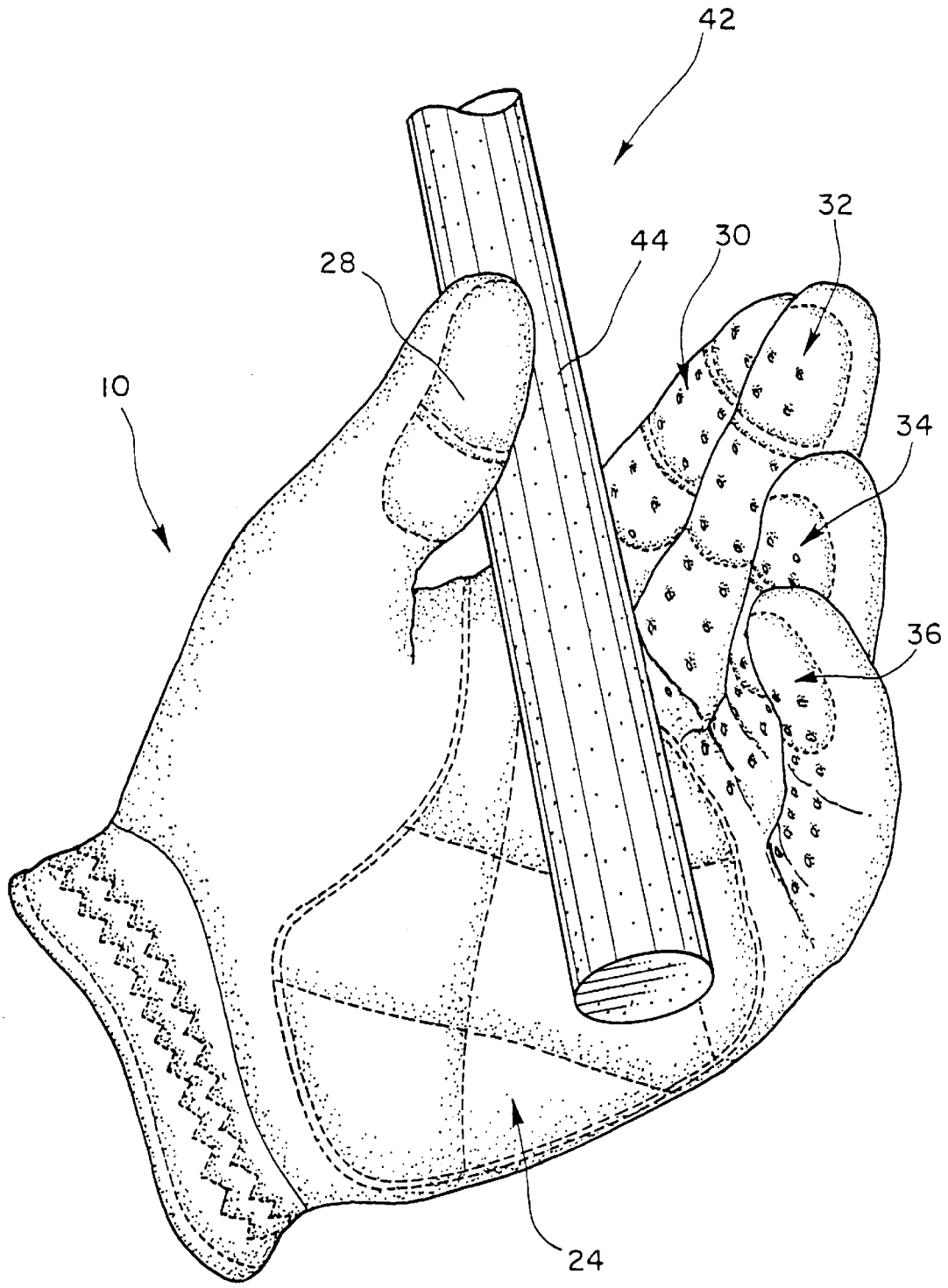
FIG. 4 illustrates the padded athletic glove of FIG. 1A holding a golf club.

Turning now to FIG. 4, an exemplary method of the present invention will be described. FIG. 4 depicts a flexible golf glove 10 as previously described in conjunction with FIGS. 1, 2 and 3. As shown, a wearer of golf glove 10 wraps the finger portions and thumb portion around a golf club grip 44 in order for the wearer to hold onto a golf club 42. In this manner, a golf glove 10 wearer, whether using an overlap or interlock grip, has the golf club grip 44 come into contact with the golf glove 10 resilient pads 24, 28, 30, 32, 34, 36. In this way, by griping a golf club 42 as it is used in the game of golf, the wearer has a large percentage of the palmar portion of the wearer's golf glove 10 (containing the resilient pads) come into contact with the golf club grip 44. As a result, when the user swings golf club 42 to strike a golf ball, vibrations created by a golf club head (not shown) striking the ball, or the ground, are dampened by the resilient pads in the wearer's golf glove 10.

Figure 5:
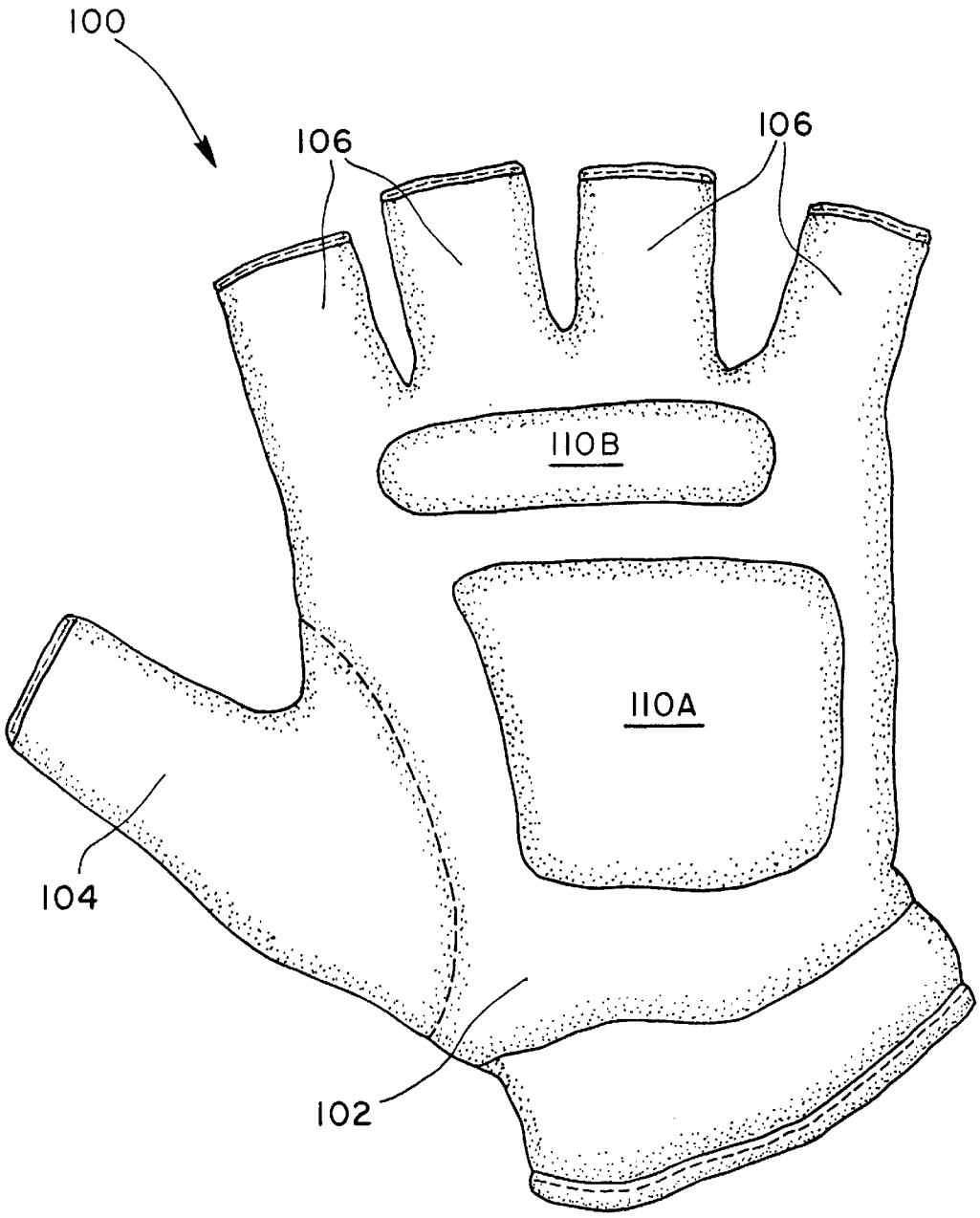
FIG. 5 illustrates a padded glove having partial fingers according to the present invention.

FIG. 5 depicts an alternative embodiment of a flexible glove 100 according to the present invention. Glove 100 depicted in FIG. 5 may find its most use as a driving glove, or as a glove for sports in which the participant wants the fingertips and/or thumb tip to be exposed. For example, glove 100 may be an exemplary driving glove or biking glove. Glove 100 is ostensibly as described in conjunction with earlier Figures, except the portions for receiving a wearer's digits are partial thumb/finger portions. More specifically, glove 100 has a partial thumb portion 104 and a plurality of partial finger portions 106 operably attached to a glove body 102. Each thumb and finger portion is adapted to cover only a portion of a wearer's corresponding digit.

Glove 100 further includes a resilient pad 110 comprising silicon foam operably attached to a palmar side of glove body 102. FIG. 5 depicts pad 110 as comprising a first portion 110A and a second portion 110B. Again, pad 110 can have a single portion, or more than the two portions depicted. The arrangement, location and size of pad 110 will depend, in part, upon the end use of glove 100. For example, for glove 100 comprising a bike glove, pad 110 may be thicker than glove 100 comprising a driving glove, due in part to the fact a bike rider typically supports more of their weight on their hands.

Figure 6:
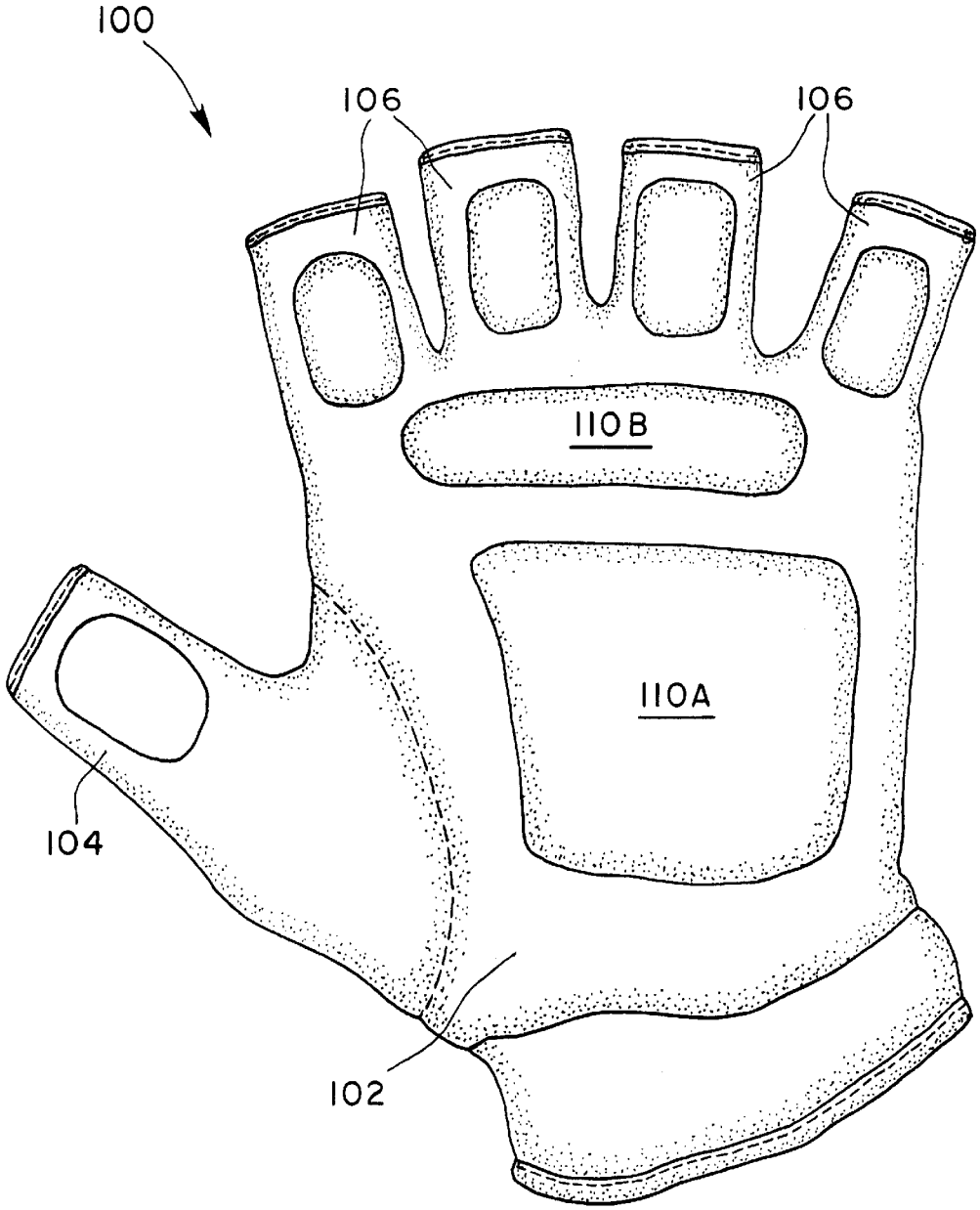
FIG. 6 illustrates a padded golf glove having partial fingers with pads according to the present invention.

FIG. 6 depicts an alternative glove embodiment according to the present invention showing a partial finger glove similar to that shown in FIG. 5. This embodiment further includes resilient pads on the palmar portions of the partial finger and thumb portions, similar to pad portions 30A, 32A, 34A and 36A shown in FIG. 1B.

The invention has now been described in detail. However, it will be appreciated that certain changes and modifications may be made. Therefore, the scope and content of this invention are not limited by the foregoing description. Rather, the scope and content are to be defined by the following claims.

What is claimed is:

1. A flexible athletic glove, comprising:

a glove body having a palmar side and a dorsal side;

a plurality of finger portions and a thumb portion each having a palmar side and a dorsal side, wherein said finger portions and thumb portion are operably attached to said glove body; and a first resilient pad comprising silicon foam and operably attached to the palmar side of said glove body.

2. A flexible athletic glove as in claim 1, further comprising a second resilient pad operably attached to the palmar side of said thumb portion, and a third resilient pad operably attached to the palmar side of one of said finger portions, said second and third resilient pads comprising silicon foam.

3. A flexible athletic glove as in claim 2, wherein the third resilient pad is operably attached to the palmar side of a first finger portion which is adapted to receive the index finger.

4. A flexible athletic glove as in claim 2, further comprising a fourth resilient pad operably attached to the palmar side of a second finger portion which is adapted to receive the middle finger, a fifth resilient pad operably attached to the palmar side of a third finger portion which is adapted to receive the ring finger, and a sixth resilient pad operably attached to the palmar side of a fourth finger portion which is adapted to receive the little finger, said fourth, fifth and sixth resilient pads comprising silicon foam.

5. A flexible athletic glove as in claim 4, wherein said second through sixth resilient pads each cover between about 30 percent and about 70 percent of the palmar side of said corresponding thumb and finger portions.

6. A flexible athletic glove as in claim 1, wherein said first resilient pad has a thickness between about 0.050 inches and about 0.060 inches.

7. A flexible athletic glove as in claim 1, further comprising a glove closure mechanism.

8. A flexible athletic glove as in claim 1, wherein at least a part of the dorsal portion of the glove body comprises a nylon mesh.

9. A flexible athletic glove as in claim 4, wherein said first through sixth resilient pads have a thickness between about 0.010 inches and about 0.10 inches.

10. A flexible athletic glove, comprising:

a glove body having a palmar side and a dorsal side;

a plurality of finger portions and a thumb portion each having a palmar side and a dorsal side, wherein said finger portions and thumb portion are operably attached to said glove body;

a first resilient pad comprising silicon foam and operably attached to the palmar side of said glove body, said first resilient pad having a thickness between about 0.050 inches and about 0.060 inches; and wherein said first resilient pad has a durometer in the range of about 45 Shore A to about 55 Shore A and a specific gravity in the range of about 1.13 to about 1.16.

11. A flexible athletic glove as in claim 1, wherein the first resilient pad covers between about 30 percent and about 80 percent of the palmar side of said glove body.

12. A flexible athletic or driving glove, comprising:

a glove body having a palmar side and a dorsal side;

a plurality of partial finger portions and a partial thumb portion each having a palmar side and a dorsal side and each operably attached to said glove body, said partial thumb and partial finger portions adapted to cover only a portion of a glove wearer's thumb and fingers; and at least one resilient pad comprising silicon foam operably attached to the palmar side of said glove body.

13. A flexible athletic or driving glove as in claim 12, wherein said at least one resilient pad is operably attached to said glove body with a plurality of stitches.

14. A flexible athletic or driving glove as in claim 12, wherein said at least one resilient pad is operably attached to said glove body with an adhesive.

15. A flexible athletic or driving glove, comprising;

a glove body having a palmar side and a dorsal side;

a plurality of partial finger portions and a partial thumb portion each having a palmar side and a dorsal side and each operably attached to said glove body, said partial thumb and partial finger portions adapted to cover only a portion of a glove wearer's thumb and fingers;

at least one resilient pad comprising silicon foam operably attached to the palmar side of said glove body; and a plurality of resilient pads operably attached to the palmar side of said thumb portion and to the palmar side of said finger portions, said plurality of resilient pads comprising silicon foam.

16. A flexible athletic or driving glove as in claim 15, wherein said at least one resilient pad and said plurality of resilient pads each have a thickness between about 0.010 inches and about 0.10 inches.

17. A flexible athletic glove as in claim 15, wherein said at least one resilient pad and said plurality of resilient pads comprise pre-formed, air-blown silicon foam pads.

18. A flexible glove, comprising a glove body having a palmar side and a dorsal side;

a plurality of finger portions and a thumb portion each having a palmar side and a dorsal side, wherein said finger portions and thumb portion are operably attached to said glove body;

a plurality of resilient pads operably attached to said palmar sides of said glove body, thumb portion and at least one finger portion, said pads comprising air-blown silicon foam.

* * * * *

UNITED STATES PATENT AND TRADEMARK OFFICE

CERTIFICATE OF CORRECTION

PATENT NO. : 6,216,276 B1 
DATED : April 17, 2001
INVENTOR(S) : Bruce A. Eibert

It is certified that error appears in the above-identified patent and that said Letters Patent is hereby corrected as shown below:

Column 10,
Lines 12-13, should read -- a first resilient pad comprising pre-formed, air-blown silicon foam and operably attached to the palmar side of said glove body. --

Lines 43-45, should read --

9. A flexible athletic glove, comprising:

a glove body having a palmar side and a dorsal side;

a plurality of finger portions and a thumb portion each having a palmar side and a dorsal side, wherein said finger portions and thumb portion are operably attached to said glove body;

a first resilient pad comprising silicon foam and operably attached to the palmar side of said glove body;

a second resilient pad operably attached to the palmar side of said thumb portion, and a third resilient pad operably attached to the palmar side of one of said finger portions, said second and third resilient pads comprising silicon foam; and a fourth resilient pad operably attached to the palmar side of a second finger portion which is adapted to receive the middle finger, a fifth resilient pad operably attached to the palmar side of a third finger portion which is adapted to receive the ring finger, and a sixth resilient pad operably attached to the palmar side of a fourth finger portion which is adapted to receive the little finger, said fourth, fifth, and sixth resilient pads comprising silicon foam;

[A flexible athletic glove as in claim 4,] wherein said first through sixth resilient pads have a thickness between about 0.010 inches and about 0.10 inches. --

Lines 60-62, should read --

11. A flexible athletic glove, comprising:

a glove body having a palmar side and a dorsal side;

a plurality of finger portions and a thumb portion each having a palmar side and a dorsal side, wherein said finger portions and thumb portion are operably attached to said glove body; and a first resilient pad comprising silicon foam and operably attached to the palmar side of said glove body;

[A flexable athletic glove as in claim 1,] wherein the first resilient pad covers between about 30 percent and about 80 percent of the palmar side of said glove body. --

Column 11,
Lines 3 and 4, should read -- at least one resilient pad comprising pre-formed, air-blown silicon foam operably attached to the palmar side of said glove body. --

UNITED STATES PATENT AND TRADEMARK OFFICE

CERTIFICATE OF CORRECTION

PATENT NO. : 6,216,276 B1
DATED : April 17, 2001
INVENTOR(S) : Bruce A. Eibert

It is certified that error appears in the above-identified patent and that said Letters Patent is hereby corrected as shown below:

Column 12,
Lines 16-19, should read -- a plurality of resilient pads operably attached to said palmar sides of said glove body, thumb portion and at least one finger portion, said pads comprising air-blown silicon foam; and wherein said pads have a thickness that is between about 0.010 inches and about 0.10 inches. --

Signed and Sealed this

Second Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,216,276 B1 
DATED : April 17, 2001
INVENTOR(S) : Bruce A. Eibert

It is certified that error appears in the above-identified patent and that said Letters Patent is hereby corrected as shown below:

Column 10,
Lines 12-13, should read -- a first resilient pad comprising pre-formed, air blown silicon foam and operably attached to the palmar side of said glove body. --

Lines 43-45, should read --

9. A flexible athletic glove, comprising:

a glove body having a palmar side and a dorsal side;

a plurality of finger portions and a thumb portion each having a palmar side and a dorsal side, wherein said finger portions and thumb portions are operably attached to said glove body;

a first resilient pad comprising silicon foam and operably attached to the palmar side of said glove body;

a second resilient pad operably attached to the palmar side of said thumb portion, and a third resilient pad operably attached to the palmar side of one of said finger portions, said second and third resilient pads comprising silicon foam; and a fourth resilient pad operably attached to the palmar side of a second finger portion which is adapted to receive the middle finger, a fifth resilient pad operably attached to the palmar side of a third finger portion which is adapted to receive the ring finger, and a sixth resilient pad operably attached to the palmar side of a fourth finger portion which is adapted to receive the little finger, said fourth, fifth, and sixth resilient pads comprising silicon foam;

wherein said first through sixth resilient pads have a thickness between about 0.010 inches and about 0.10 inches. --

Lines 60-62, should read --

11. a flexible athletic glove, comprising:

a glove body having a palmar side and a dorsal side;

a plurality of finger portions and a thumb portion each having a palmar side and a dorsal side, wherein said finger portions and thumb portion are operably attached to said glove body; and a first resilient pad comprising silicon foam and operably attached to the palmar side of said glove body;

wherein the first resilient pad covers between about 30 percent and about 80 percent of the palmar side of said glove body. --

Column 11,
Lines 3 and 4, should read -- at least one resilient pad comprising pre-formed, air-blown silicon foam operably attached to the palmar side of said glove body. --

UNITED STATES PATENT AND TRADEMARK OFFICE

CERTIFICATE OF CORRECTION

PATENT NO. : 6,216,276 B1
DATED : April 17, 2001
INVENTOR(S) : Bruce A. Eibert

It is certified that error appears in the above-identified patent and that said Letters Patent is hereby corrected as shown below:

Column 12,
Lines 16-19, should read -- a plurality of resilient pads operably attached to said palmar sides of said glove body, thumb portion and at least one finger portion, said pads comprising air-blown silicon foam; and wherein said pads have a thickness that is between about 0.010 inches and about 0.10 inches. --

This certificate supersedes Certificate of Correction issued July 2, 2002.

Signed and Sealed this

Twenty-second Day of March, 2005

JON W. DUDAS
*Director of the United States Patent and Trademark Office*